US005911743A

United States Patent [19]

Shaw

[11] Patent Number: 5,911,743

[45] Date of Patent: Jun. 15, 1999

[54] EXPANSION/SEPARATION COMPRESSOR SYSTEM

[76] Inventor: David N. Shaw, 200 D Brittany Farms Rd., New Bristain, Conn. 06053

[21] Appl. No.: 08/807,796

[22] Filed: Feb. 28, 1997

[51] Int. Cl.[6] ..... F25D 17/02; F25B 43/02

[52] U.S. Cl. ..... 62/84; 62/201; 418/97

[58] Field of Search ..... 418/97, 201.1; 62/50.3, 87, 402, 201, 471, 469, 84

[56] References Cited

U.S. PATENT DOCUMENTS

| | | | |
|---|---|---|---|
| 1,295,724 | 2/1919 | Frankenberg | 62/402 |
| 3,138,320 | 6/1964 | Schibbye | 418/201.1 X |
| 4,497,185 | 2/1985 | Shaw | 62/468 |
| 4,512,302 | 4/1985 | Bunce | 123/238 |
| 4,748,831 | 6/1988 | Shaw | 62/505 |
| 4,829,786 | 5/1989 | Sand et al. | 62/84 |
| 5,653,585 | 8/1997 | Fresco | 418/100 |

*Primary Examiner*—William Wayner
*Attorney, Agent, or Firm*—Cantor Colburn LLP

[57] ABSTRACT

An expansion/separation compressor system is presented for a multi-rotor compressor configuration. In accordance with the present invention the rotors are disposed in a shell having open and closed off portions for providing expansion, compression and separation. The closed off portions depend from or are attached to other suitable compressor structure including the induction or discharge plates. In an embodiment the expansion portion is comprised of a sliding valve. Separation is achieved when the flute and respective open shell portion expose the fluid to basic plenum pressure. The fluid is essentially removed by centrifugal force through the opening in the shell. The compressor is mounted to an evaporator and a control system is provided to regulate the temperature of water in the evaporator thereby controlling the rate of evaporation of liquid phase refrigerant in the evaporator. The liquid phase refrigerant is expanded between the rotors and respective shell portions to a desired volume. Further, the present invention presents foam generated from the liquid phase refrigerant to an opening in the shell at the induction side of the compressor for cooling, sealing and lubrication purposes. In accordance with the present invention the capacity of above described system can be varied without mechanical unloading.

44 Claims, 9 Drawing Sheets

EXPANSION/SEPARATION COMPRESSOR SYSTEM

BACKGROUND OF THE INVENTION

The present invention relates to systems for cooling which employing a helical screw type compressor. More specifically, the present invention relates to an expansion/separation multi-screw compressor in a variable capacity vapor compression cooling system.

Cooling systems in the HVAC (heating, ventilation and air conditioning) industry are well known. By way of example, a schematic diagram of a typical cooling system is shown in FIG. 1 herein, labeled prior art. Referring to FIG. 1 herein, water enters an evaporator 412 through an input 414 where it is circulated through tubes within the evaporator and exits through an output 416. Liquid phase refrigerant enters evaporator 412 at an input 420 and evaporated refrigerant is delivered to a compressor 422 (e.g., a helical twin screw type compressor, which are well known in the art). Compressed vapor phase refrigerant is passed through an oil separator 424 for removing oil picked up in compressor 422. Thereafter the compressed vapor phase refrigerant is presented to a water cooled condenser 426 to condense the refrigerant to the liquid phase which is used for cooling, as is well known in the art. It will also be appreciated that air cooled condensers are well known and such could be used in place of the aforementioned water cooled condenser. Thereafter, liquid phase refrigerant is presented to an economizer 428 where vapor phase refrigerant (it is well known that a small portion of the refrigerant will be vapor, i.e., flash gas) is drawn off and delivered directly to the compressor. The liquid phase refrigerant is presented to input 420 of evaporator 412, thereby completing the cycle. When capacity of such a system is to be varied, it is common to unload the compressor, however, this is both inefficient and invariably, seriously complicates the overall design/cost of the compressor.

Further, helical type compressors are well known in the art. One such helical compressor employs one male rotor axially aligned with and in communication with one female rotor. The pitch diameter of the female rotor is usually greater than the pitch diameter of the male rotor. Typically, the male rotor is the drive rotor, however compressors have been built with the female rotor being the drive rotor. The combination of one male rotor and one female rotor in a compressor is commonly referred to as a twin screw or rotor, such is well know in the art and has been in commercial use for decades. An example of one such twin rotor commonly employed with compressors in the HVAC (heating, ventilation and air conditioning) industry comprises a male rotor which drives an axially aligned female rotor. A resulting gap between the male and female rotors requires oil to be introduced into the compression area for sealing, however, the oil also provides cooling and lubricating, as is well known. However, the introduction of this oil requires the use of an oil separation device, to separate the oil from the refrigerant being compressed in HVAC compressors. A primary benefit of the twin rotor configuration is the low interface velocity between the male and female rotors during operation. However, the twin rotor configuration incurs large radial bearing loads and thrust loads. The obvious solution to alleviating the bearing load problem would be to install sufficiently sized bearings. This is not a feasible solution, since the relative diameters of the rotors in practice result in the rotors being too close together to allow installation of sufficiently sized bearings.

The prior art has addressed this problem, with the introduction compressors employing 'so-called' single screw technology. A single screw configuration comprises a drive rotor with two opposing axially perpendicular gate rotors. The gate rotors are generally comprised of a composite material which allows positioning of the gate rotor with small clearances from the drive rotor. These clearances are small enough that the liquid refrigerant itself provides sufficient sealing, the liquid refrigerant also provides cooling and lubrication. The rearward positioning of gate rotors and the positioning on opposing ends of the drive rotor, (1) allows equalizing suction of pressure at both ends of the drive rotor thereby virtually eliminating the thrust loads encountered with the above described twin screw system and (2) balances the radial loading on the drive rotor thereby minimizing radial bearing loads. However, the interface velocity between the gate rotors and the drive rotor are very high. Accordingly, a common problem with this system is the extensive damage suffered by the rotors when lubrication is lost, due to the high interface velocities of the rotors.

SUMMARY OF THE INVENTION

The above-discussed and other drawbacks and deficiencies of the prior art are overcome or alleviated by the expansion/separation compressor system of the present invention. In accordance with the present invention, a compressor has a housing for supporting a multi-rotor configuration (e.g., a male rotor and two axially aligned female rotors) and a drive motor. The drive shaft of the motor is integral with or coupled to the shaft of the male rotor for driving the same. A bearing is mounted at this shaft in between the motor and the male rotor and is supported in a lower bearing plate attached to the compressor housing by a plurality of spaced apart support arms. The female rotors have shafts with bearings mounted thereon which are supported by the lower bearing plate.

The rotors are disposed in a shell comprising open and closed off portions which depend from or are attached to the compressor housing. The closed off portions are located for accomplishing compression and expansion. The open portions allow for separation.

An induction plate is mounted at the induction end of the rotors. The induction plate closes off a portion of the induction end between the rotors. Inlet channels originate from an edge of the induction plate and extend therein to passages which are open to the interface of the rotors. Each passage is roughly triangularly shaped with one side thereof following the root circumference of the corresponding female rotor, the second side following the outside diameter of the male rotor and the third side following a corresponding leading edge of a female flute at the liquid inlet cutoff position desired. Fittings on the compressor housing are connected to channels which lead to the inlet channels in the induction plate.

A discharge plate is mounted at the discharge end of the rotors. The discharge plate includes discharge port openings, female rotor shaft openings with the female rotor shafts having bearing spacers thereon, and a recess for receiving a discharge disk. A clearance is defined between the outer circumference of the discharge disk and the inner circumferential surface of the recess. An inwardly countersunk surface depends from the inner circumferential surface, which allows the clearance between the discharge disk and the inner circumferential surface to be sealed by the entrained liquid, thereby minimizing leakage back to the low end of the compressor. The discharge end of the male rotor being sealed by the discharge disk causes the pressure on both ends of the male rotor to be equalized. The countersunk surface terminates at an opening with the male rotor shaft having a bearing spacer thereon, disposed therein. The compression and discharge ends of the rotors communicate with the discharge porting in the discharge plate.

The length of the male rotor is slightly longer than the length of the female rotors, thereby providing axial clearance between the female rotors and the discharge plate. The male rotor shaft bearing spacer has a length equal to the thickness of the discharge plate. The female rotor shaft bearing spacers have a length equal to the sum of the height of the rotor clearance (i.e., the additional length of the male rotor as compared to the length of the female rotors) and the thickness of the discharge plate. Further, there are clearances between each of these bearing spacers and the respective pass through openings and between the edge of the discharge disk and the recess in the discharge plate. Lubrication is leaked (or flashed) through these clearances to the bearings described below for lubricating the same.

An upper bearing plate has a male rotor shaft bearing supported therein with the inner race thereof supported by the male rotor shaft bearing spacer and the outer race thereof supported by the discharge plate. Female rotor shaft bearings are supported within the upper bearing plate with the inner races thereof supported by the female shaft bearing spacers and the outer races thereof supported by the discharge plate. These upper bearings are retained about the shafts by end caps which are connected to the shafts and secure the inner races of the bearings. The upper bearing plate includes pass through discharge port openings.

A compressor end plate is mounted on the upper bearing plate. The compressor end plate has recesses for receiving the end caps. Belville washers are disposed between the outer races of the upper bearings and the compressor end plate. The compressor end plate includes discharge port passage ways which lead to a compressor outlet.

The motor is supported in the compressor housing by a plurality of spaced apart members depending inwardly from the housing. The motor is preferably a variable speed motor, whereby compressor capacity can be controlled by varying motor speed which directly varies the drive rotor speed. A motor retention ring retains the motor and is attached to these members. The compressor housing is open at the lower end thereof and terminates at this lower end in a mounting flange.

The compressor is mounted on an evaporator so that the open end of the compressor is aligned with an opening at the upper end of the evaporator. A variable capacity vapor compression cooling system is presented. Air conditioning requirements are entered into a microprocessor which controls the system. Water enters the evaporator through an input where it is circulated through tubes within the evaporator and exits through an output. The entering and exiting water temperature are measured and presented to the microprocessor. The regulation of the water temperature allows control of the rate of evaporation of the liquid phase refrigerant in the evaporator. Liquid phase refrigerant is delivered to the evaporator by the compressor. More particularly, liquid phase refrigerant is delivered at the compressor inlet fittings which communicate with the channels and thereby the passages in the induction plate. The interlobe/flute cell volume between the respective rotors and respective shell portions where this liquid phase refrigerant enters is expanding as the rotors are rotated (driven). This volume expands the two-phase (i.e., a liquid portion and a vapor portion) fluid therein to the desired volume. This expanded fluid within the closed interlobe/flute cells is then exposed to the basic intake plenum of the compressor, whereby the liquid portion of the refrigerant is now thrown out of the interlobe/flute cell by centrifugal forces. The vapor portion remaining in the cell mixes with vapor generated by the evaporator. The liquid portion which has in effect been centrifuged our of the two-phase liquid falls into the evaporator. Further, energy expended in this expansion process is not wasted, as the work of expansion aids in driving the rotors. The closed volume or cell of each of these expansion volumes can be varied, thereby allowing the expansion volume to be regulated (varied) to regulate or control the expansion. Accordingly, the compressor also performs the expansion function for the system. Evaporated refrigerant (i.e., vapor phase refrigerant) and the vapor phase refrigerant from expansion is inducted (drawn) into the compressor at the suction end thereof. The vapor phase refrigerant is compressed by the compressor. The compressed vapor phase refrigerant is then presented to a condenser, condensing the refrigerant to the liquid phase. Thereafter, liquid phase refrigerant is delivered to the inlet fittings of the compressor, with the flow thereto being somewhat regulated by a microprocessor controlled regulator valve.

The liquid phase refrigerant that falls down into the evaporator and collects in the evaporator which is flooded with liquid refrigerant to a level. The liquid refrigerant is boiled resulting in a foam, froth and/or oil rich vapor refrigerant mist, fog or smoke, all of which are referred to herein as foam, forming on top of the liquid level in the evaporator. The prior art seeks to reduce this foaming process with the use of, e.g., anti-foaming agents and other known mechanical means. However, the present invention utilizes this foam for compressor cooling, sealing and lubrication. The small amount of oil in the refrigerant tends to be much more highly concentrated towards the top of the liquid refrigerant in the evaporator, as oil is lighter than the liquid refrigerant and the liquid refrigerant is being evaporated. The foam comprises liquid refrigerant having this higher concentration oil and vapor refrigerant. In accordance with an important feature of the present invention, this foam is ingested into the compressor. The motor, bearings and the compression process itself are cooled and lubricated by the oil in the foam. The foam that is drawn into the suction end of the rotors is compressed. More specifically, the vapor contained in the foam is compressed and the liquid in the foam seals and cools the compression process and also serves as a lubrication source for the upper bearings. Also, vapor phase refrigerant generated in the evaporator and drawn into the compressor is compressed, as described hereinbefore.

Accordingly, the above describes a complete cycle which can be capacity varied without the internal mechanical unloading of the compressors common in the prior art.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
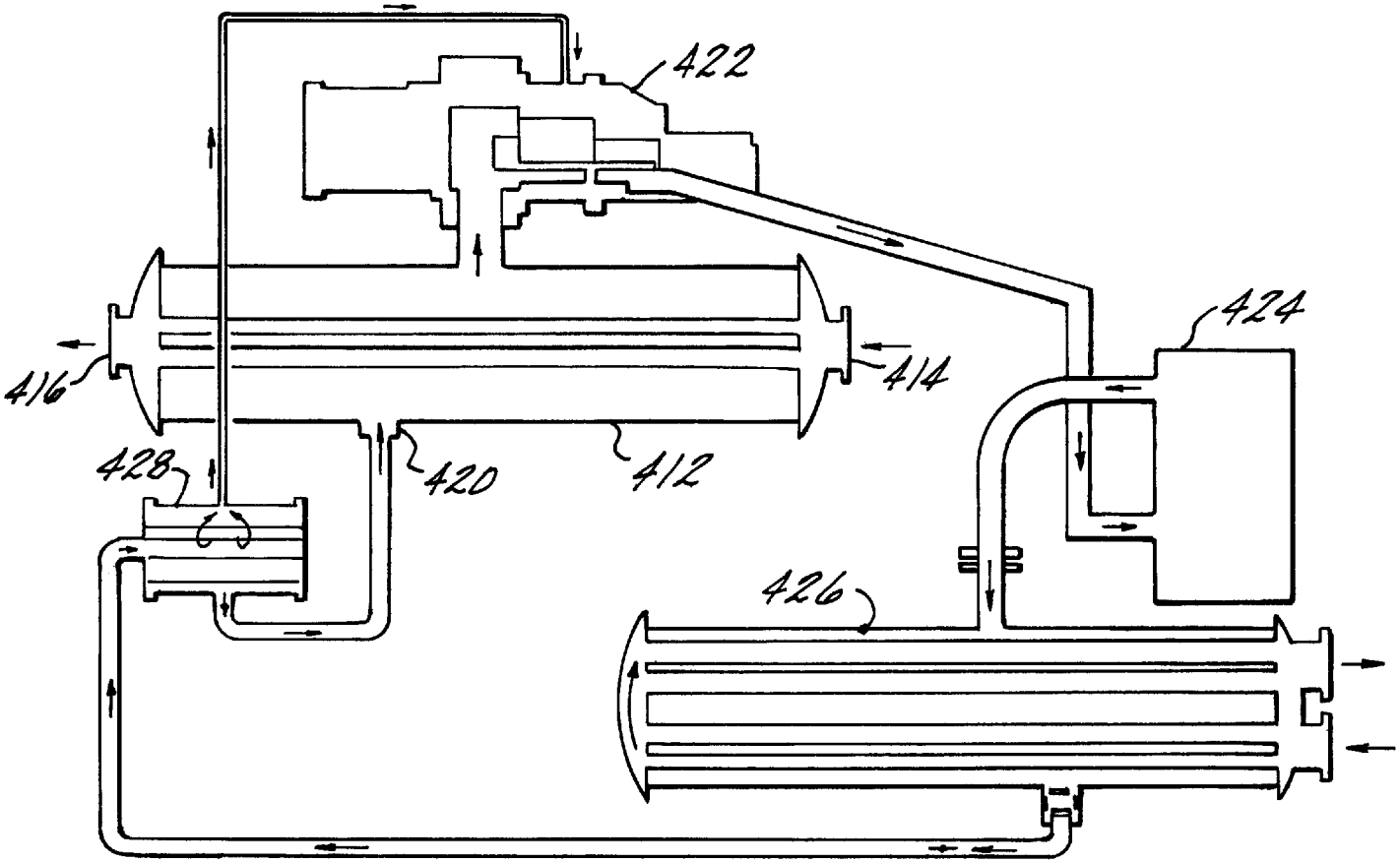
FIG. 1 (PRIOR ART)
FIG. 1 a schematic diagram of a vapor compression cooling system in accordance with the prior art.
Figure 2:
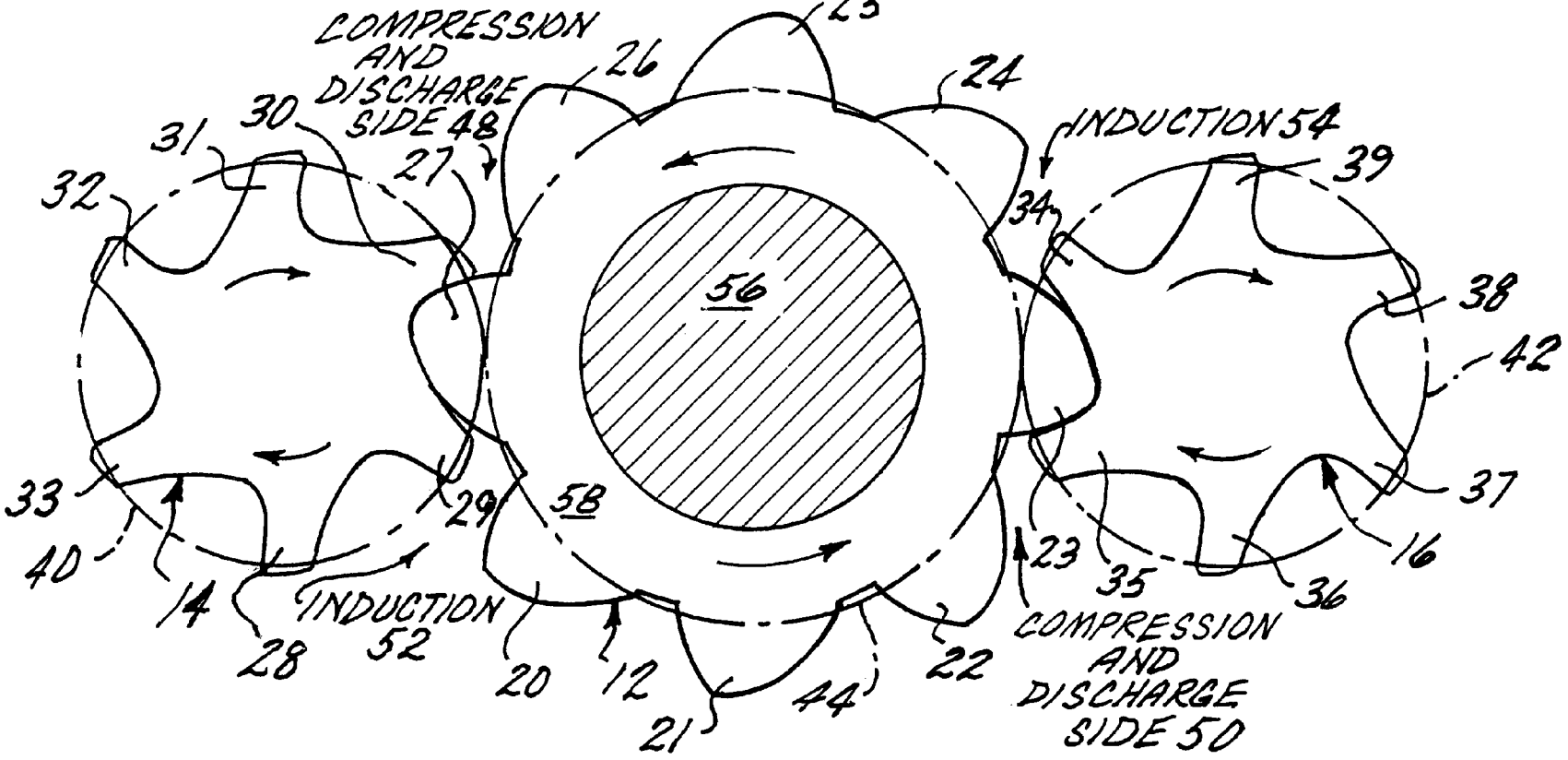
FIG. 2 is a diagrammatic cross sectional view of a tri-rotor configuration in accordance with the present invention.

Referring now to FIG. 2, a cross sectional view of a rotor configuration used in a compressor 10 is generally shown. A male rotor 12 is axially aligned with and in communication with female rotors 14 and 16. Male rotor 12 is driven by motor 18, described hereinafter. In this example, male rotor 12 has eight lobes (teeth) 20–27 with a 150° wrap, female rotor 14 has six flutes (teeth) 28–33 with a 200° wrap, and female rotor 16 has six flutes 34–39 with a 200° wrap. The pitch diameters 40, 42 of the female rotors 14, 16 are less than the pitch diameter 44 of the male rotor 12. Accordingly, the compression phase of the axial sweep with respect to male rotor 12 occupies 150° of rotation with the timing between the closed discharge ports 48, 50 and the closed suction ports 52, 54 occupying the remaining 30° of rotation. Duplicate processes are occurring simultaneously on the top and bottom of the male rotor.

Male rotor 12 comprises an inner cylindrical metal shaft 56 with an outer composite material ring 58 mounted thereon, such being more fully described in U.S. patent application Ser. No. 08/550,253, entitled MULTI-ROTOR HELICAL SCREW COMPRESSOR, which is expressly incorporated herein by reference. The clearance between the male and female rotors is small enough, due to the use of the composite material, that the oil/liquid refrigerant provides sufficient sealing, however, a small amount (percent by weight) of oil which is miscible in the refrigerant also provides cooling and lubrication. Accordingly, the need to inject oil into the compression area, such as in the prior art twin screw compressors for sealing, cooling and lubricating is eliminated because the composite material can be adequately lubricated with liquid refrigerant/oil therein.

Figure 3:
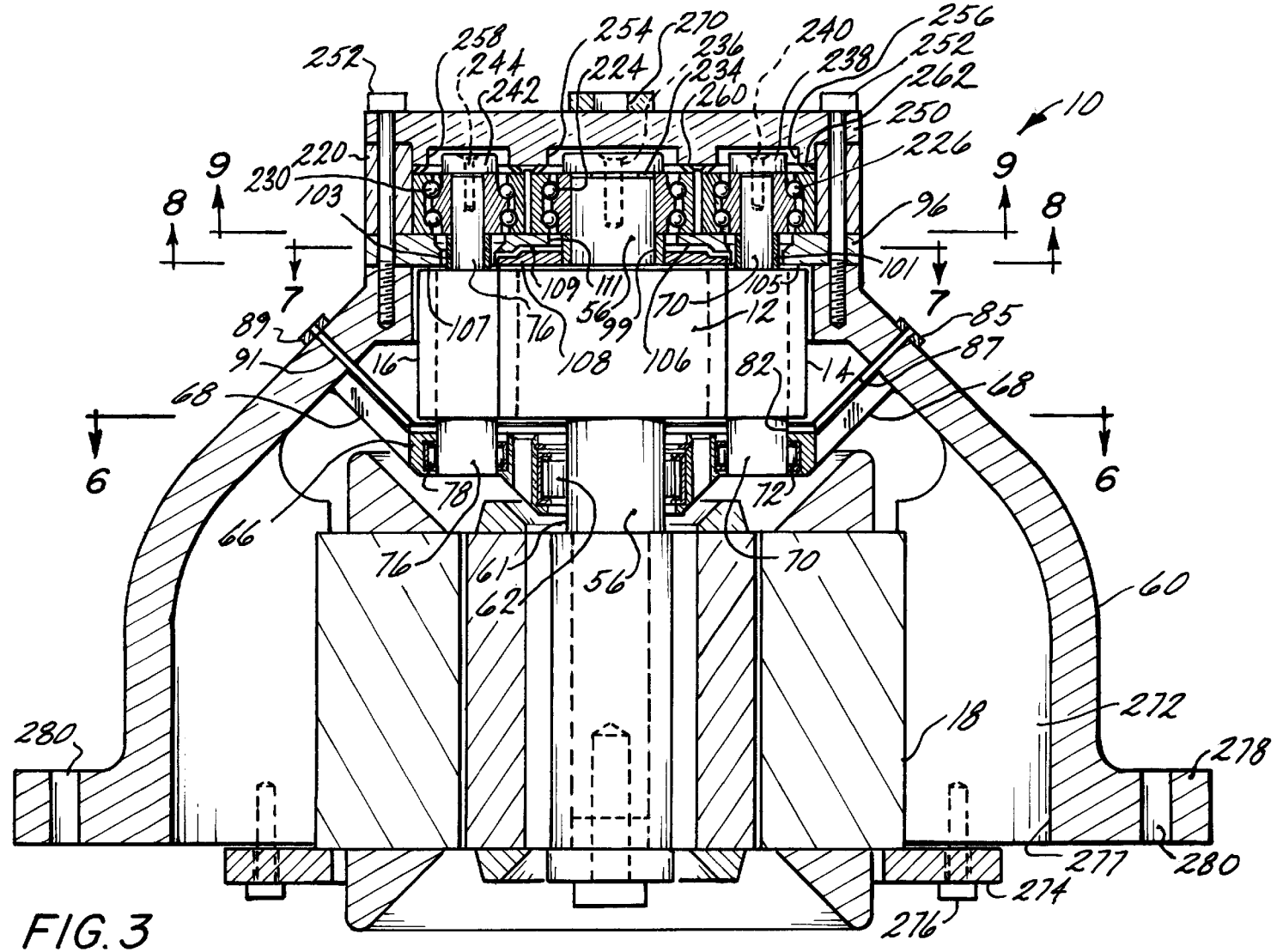
FIG. 3 is a cross sectional view of an expansion/separation compressor in accordance with the present invention.
Figure 4:
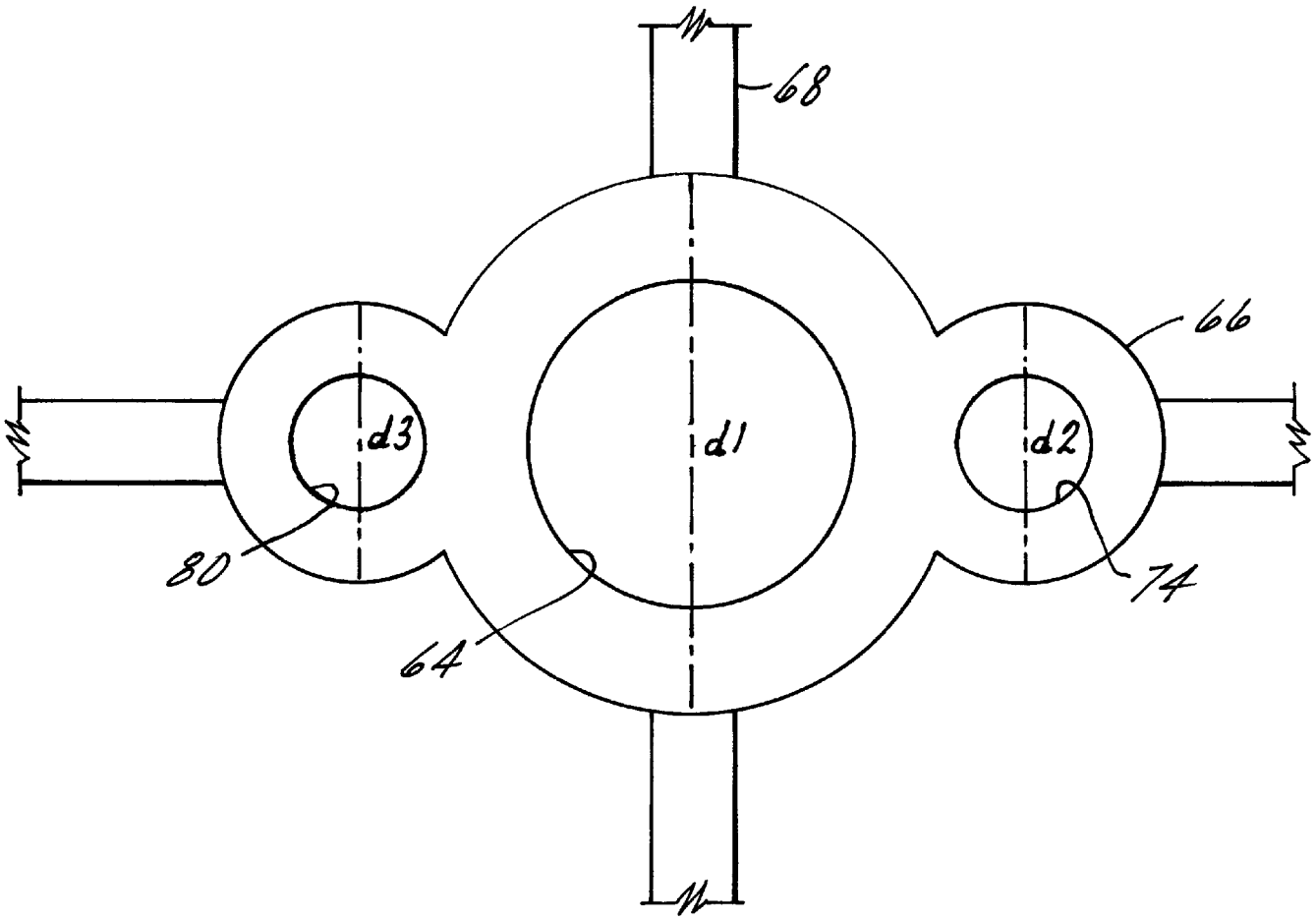
FIG. 4 is a view of the lower bearing plate of the expansion/separation compressor of FIG. 3.

Referring to FIG. 3, compressor 10 employing the above described rotor configuration is generally shown. Compressor 10 has a housing 60 for supporting the rotors and drive motor 18. Motor 18 has a drive shaft 61 which is integral with or coupled to shaft 56 of male rotor 12 for driving the same. A bearing 62 is mounted at shaft 56 in between motor 18 and rotor 12 and is supported within an opening 64 in a lower bearing plate 66 (FIG. 4). The diameter $d_1$ of plate 66 is preferably about the same as the root diameter of male rotor 12. Plate 66 is attached to housing 60 (or is formed integral therewith) by a plurality of spaced apart support arms 68 extending outwardly and upwardly from plate 66 to housing 60. Female rotor 14 has a shaft 70 with a bearing 72 mounted thereat which is supported within an opening 74 of plate 66. Female rotor 16 has a shaft 76 with a bearing 78 mounted thereat which is supported within an opening 80 of plate 66. The diameters $d_2$ and $d_3$ are preferably about the same as the respective root diameters of female rotors 14 and 16.

Figure 5:
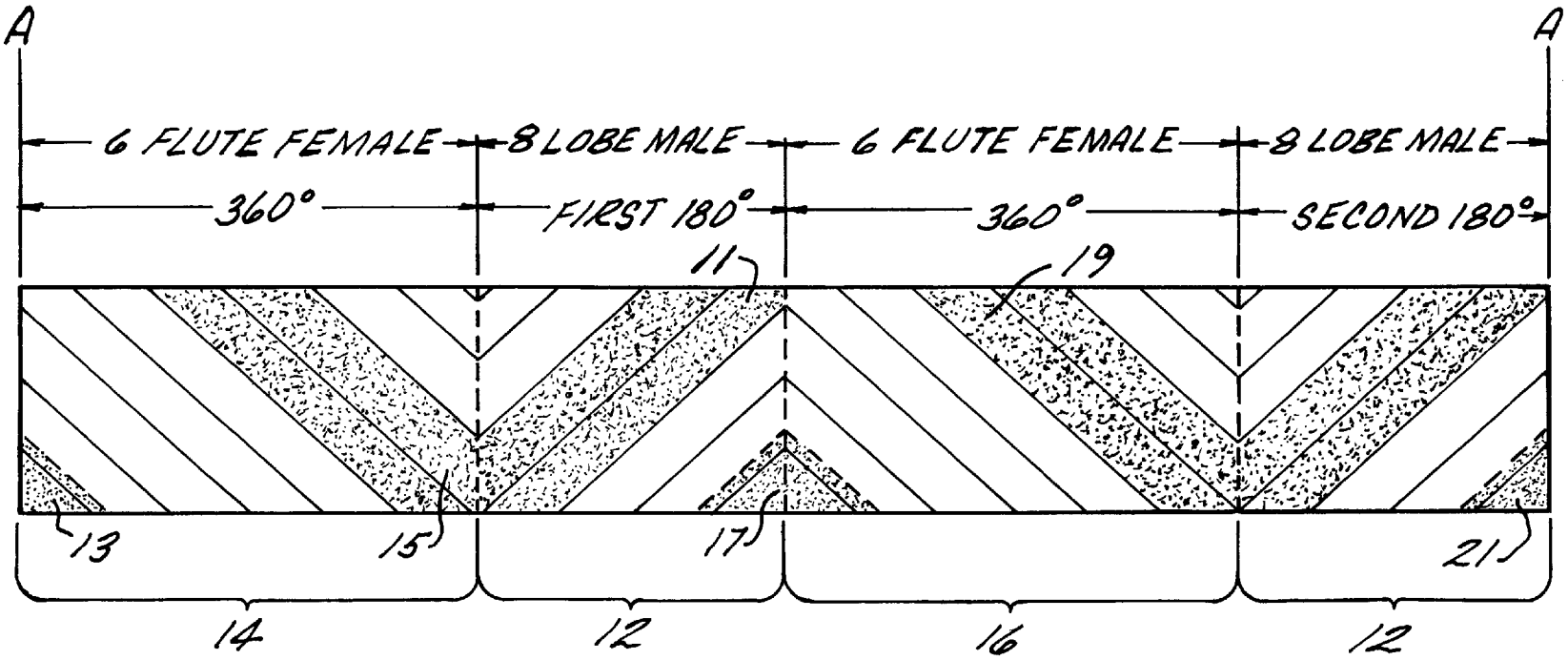
FIG. 5 is a diagrammatic unwrapped pitch line study of the tri-rotor configuration of FIG. 2 illustrating the rotor shell configuration of the expansion/separation compressor of FIG. 3.

Referring to FIG. 5, a diagrammatic unwrapped pitch line study is provided for the present rotor configuration. Rotor profile may be such as shown and described in U.S. Pat. No. 4,667,646, entitled EXPANSION COMPRESSION SYSTEM FOR EFFICIENT POWER OUTPUT REGULATION OF INTERNAL COMBUSTION ENGINES, which is expressly incorporated herein by reference. The male rotor is shown in two equal sections for purposes of illustration. Moreover, the open and closed off portions of a rotor assembly shell 11, which is disposed about the rotors, is shown. Shell 11 is comprised of these closed off portions 13, 15, 17, 19 and 21 which depend from or are attached to housing 60 or any other suitable structure of the compressor (e.g., the induction and/or discharge plates, described below). Closed off portions 13, 15, 17, 19 and 21 are permanently located as shown in FIG. 5, whereby the position of the rotors is selected and shown to aid in the description of the shell. Portions 15 and 19 close off equal volumes for compression. Portions 13 and 21 together close off the same volume as portion 17 for expansion. Further, portion 17 closes off about 15%–25% of the volume that portion 15 closes off and portions 13 and 21 together close off about 15%–25% of the volume that portion 19 closes off. The open portions allow for separation, as described more fully hereinafter.

Figure 6:
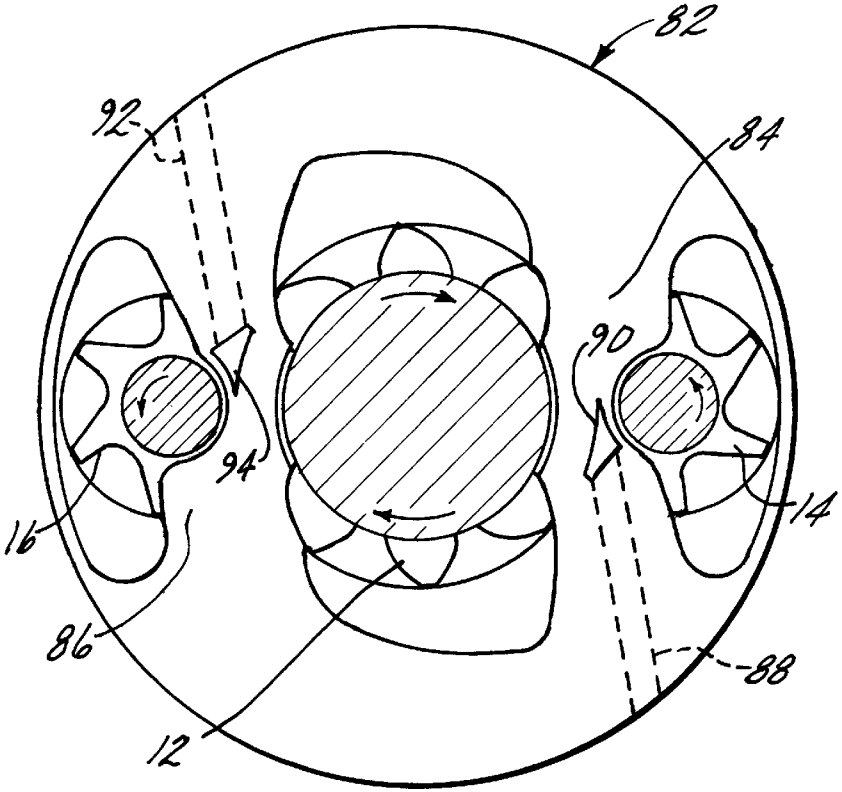
FIG. 6 is a view of the induction plate of the expansion/separation compressor of FIG. 3.

Referring to FIGS. 3 and 6, an induction plate 82 is mounted at the induction end of the rotors. Plate 82 includes a portion 84 which closes off a portion of the induction end between rotors 12 and 14, a portion 86 which closes off a portion of the induction end between rotors 12 and 16. An inlet channel 88 originates from an edge of plate 82 and extends therein to a passage 90 which is open to the interface of rotors 12 and 14. An inlet channel 92 originates from an edge of plate 82 and extends therein to a passage 94 which is open to the interface of rotors 12 and 16. Each passage (or port) 90 and 94 is roughly triangularly shaped with one side thereof following the root circumference of the corresponding female rotor, the second side following the outside diameter of the male rotor and the third side following a corresponding leading edge of a female flute at the liquid inlet cutoff position desired (this porting is similar to a high compression ratio axial discharge port at the female rotor side on the outlet end of a typical prior art twin screw compressor). A fitting 85 has a channel 87 leading therefrom to inlet channel 88. A fitting 89 has a channel 91 leading therefrom to inlet channel 92.

Figure 8:
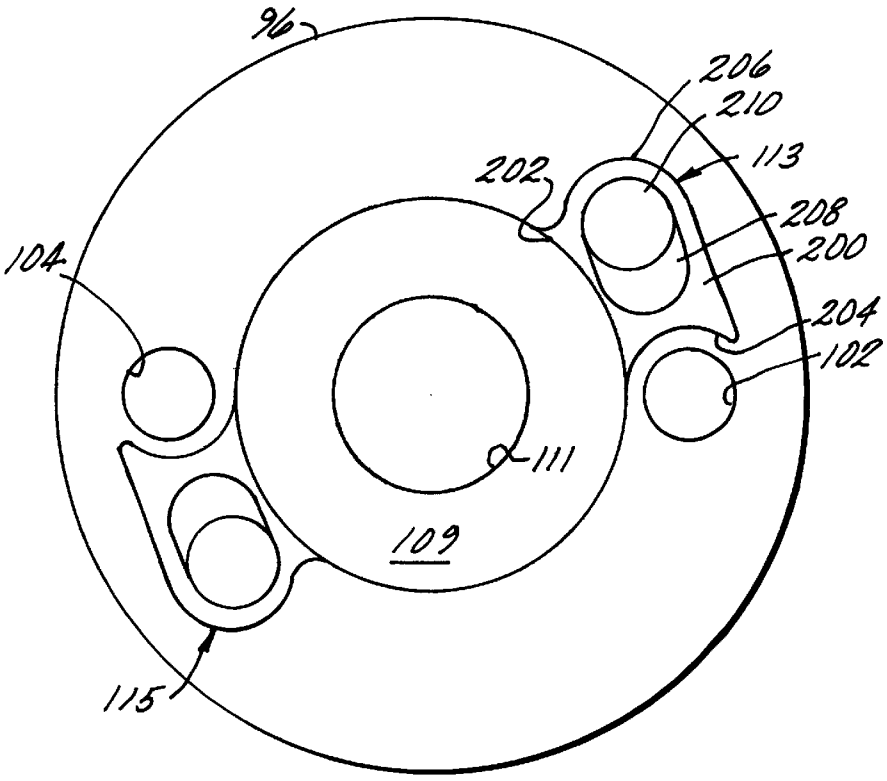
FIG. 8 is a view taken along the line 8—8 of FIG. 3 with the discharge plate removed for clarity.
Figure 7:
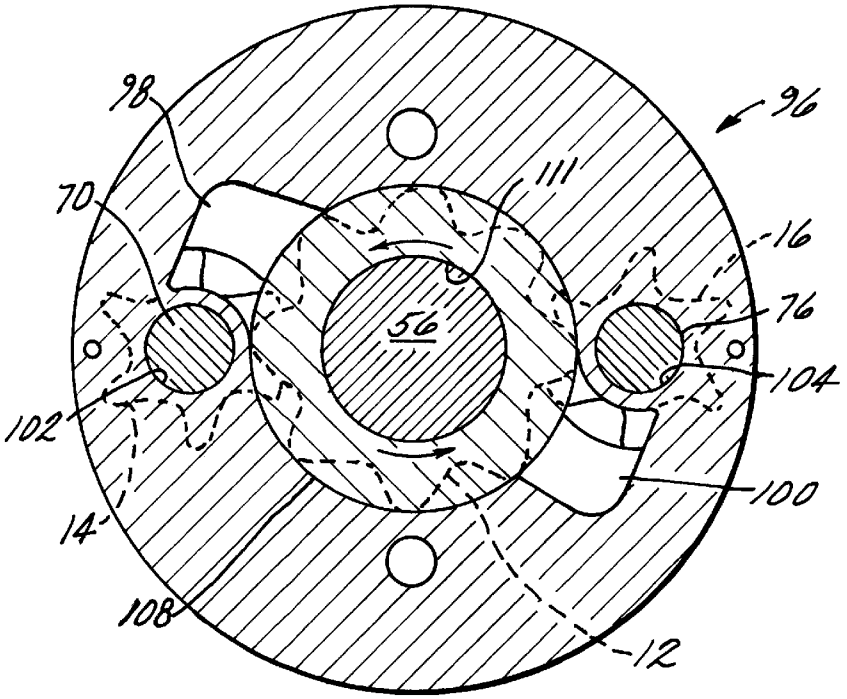
FIG. 7 is a view taken along the line 7—7 of FIG. 3.

Referring to FIGS. 3, 7 and 8, a discharge plate 96 is mounted at the discharge end of the rotors. Plate 96 includes discharge port openings 98 and I 00, openings 102 and 104 for pass through of the shafts 70, 76 of the female rotors having bearing spacers 101 and 103 thereon and a recess 106 for receiving a discharge disk 108. A clearance is defined between the outer circumference of disk 108 and the inner circumferential surface 107 of recess 106. An inwardly countersunk surface 109 depends from surface 107, which allows the clearance between disk 108 and surface 107 to be sealed by the entrained liquid, thereby minimizing leakage back to the low end of the compressor. Moreover, the discharge end of the male rotor 12 being sealed by disk 108 causes the pressure on both ends of male rotor 12 to be equalized. As is readily apparent to one of ordinary skill in the art, the high pressure at the interface of the discharge end of the male rotor 12 and the disk 108 acts on disk 108 in the direction of discharge and acts on the lobes of the male rotor 12 in an equal and opposite direction. These equal and opposite forces almost eliminate of the thrust loads on the male rotor. Countersunk surface 109 terminates at an opening 111 with the shaft 56 of the male rotor, having a bearing spacer 99 thereon, disposed therein. Compression and discharge end 48, FIG. 2, (i.e., the corresponding radial discharge area of male rotor 12 and the axial discharge port area of female rotor 14) communicates with discharge porting 113 and compression and discharge end 50, FIG. 2, (i.e., the corresponding radial discharge area of male rotor 12 and the axial discharge port area of female rotor 16) communicates with discharge porting 115.

Discharge porting 113 comprises a first stepped down portion 200 defined by a line 202 which represents the circumferential distance encompassed when surface 200 intersects inner circumferential surface 107, an edge 204 which follows the root diameter of female rotor 14 and a curved edge 206 which communicates with the periphery of the remaining radial and axial port areas, such areas being well known and defined in the art. This first stepped down portion 200 provides relief on the female rotor end of the trapped pocket, since such will be aligned with this portion. Trap pocket relief being more fully described in copending U.S. patent application Ser. No. 08/550,253, entitled MULTI-ROTOR HELICAL SCREW COMPRESSOR, which has been incorporated herein by reference. A second further stepped down portion 208 depends from stepped down portion 200 and generally aligns with the axial port area of female rotor 14. Both portions 200 and 208 lead into a discharge opening 210 which generally aligns with radial flow area. The discharge opening from discharge porting 113 and 115 are later combined and form a single discharge output for the compressor.

The length of the male rotor is slightly longer than the length of the female rotors, thereby providing axial clearance 105 and 107 between the female rotors and disk 108. Bearing spacer 99 has a length equal to the thickness of plate 96. Bearing spacers 101 and 103 have a length equal to the sum of the height of the clearance (105, 107) and the thickness of plate 96. Further, there are clearances between each of these bearing spacers and the respective pass through openings and between the edge of discharge disk 108 and recess 106, as is clearly shown in FIG. 3. Lubrication is leaked (or flashed) through these clearances to the bearings described below for lubricating the same.

The outside diameter of disk 108 is equal to the crest diameter of the male rotor 12. Disk 108 equalizes suction pressure at both ends of male rotor 12 thereby virtually eliminating the thrust loads encountered with the prior art twin screw compressors. It will be appreciated that disk 108 blocks the axial port area of the male rotor 12, however it is believed that the benefit obtained by the elimination of thrust loads outweighs the slight reduction in overall discharge port area. It should be noted that a significant portion of the axial port area of the male rotor 12 is occupied by a lobe of the rotor. Further, disk 108 having a diameter equal to the crest diameter of the male rotor 12 will not block the radial discharge port area of male rotor 12 or the axial discharge port areas of female rotors 14 and 16.

Figure 9:
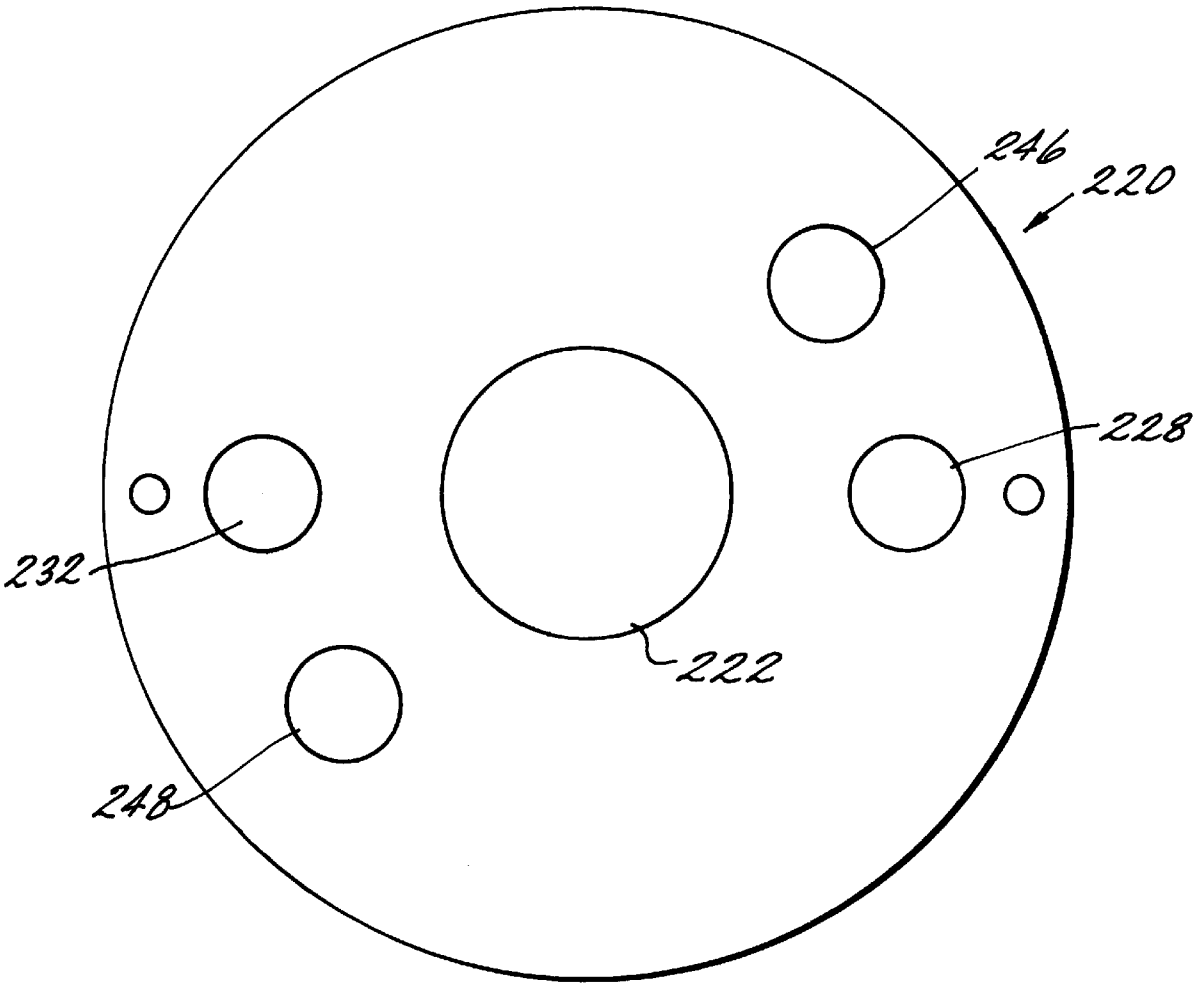
FIG. 9 is a view taken along the line 9—9 of FIG. 3 of the upper bearing plate of the expansion/separation compressor of FIG. 3.

Referring to FIGS. 3 and 9, an upper bearing plate 220 has an opening 222 with a bearing 224 supported therein, at the inner race thereof by bearing spacer 99 and at the outer race thereof by plate 96. Bearing 224 is mounted at shaft 56 at the discharge side of rotor 12. A bearing 226 is mounted at shaft 70 of female rotor 14 and is supported within an opening 228 of plate 220, at the inner race thereof by bearing spacer 101 and at the outer race thereof by plate 96. A bearing 230 is mounted at shaft 76 of female rotor 16 and is supported within an opening 232 of plate 220, at the inner race thereof by bearing spacer 103 and at the outer race thereof by plate 96. The inner race of bearing 224 is retained about shaft 56 by an end cap 234 which is mounted at the end of shaft 56 by a fastener 236. The inner race of bearing 226 is retained about shaft 70 by an end cap 238 which is mounted at the end of shaft 70 by a fastener 240. The inner race of bearing 230 is retained about shaft 76 by an end cap 242 which is mounted at the end of shaft 76 by a fastener 244. Plate 220 includes pass through discharge port openings 246 and 248.

Figure 10:
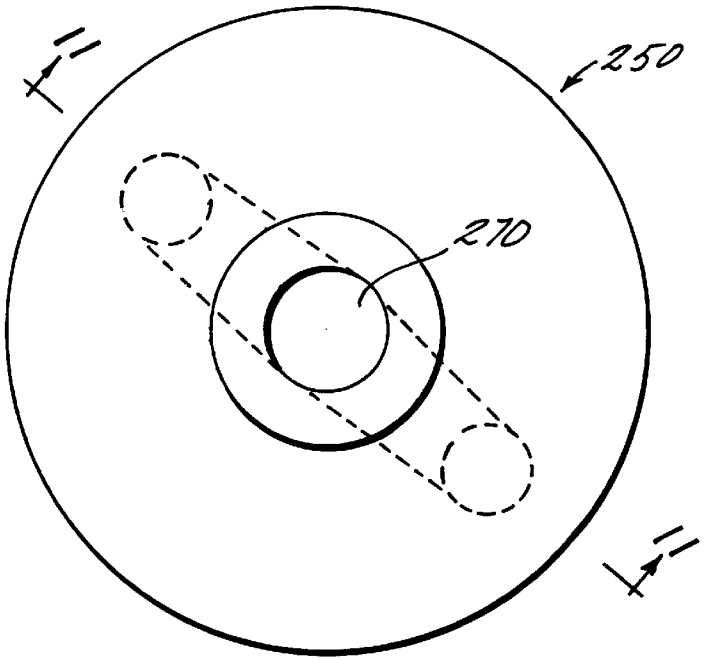
FIG. 10 is a discharge end view of the expansion/separation compressor of FIG. 3.
Figure 11:
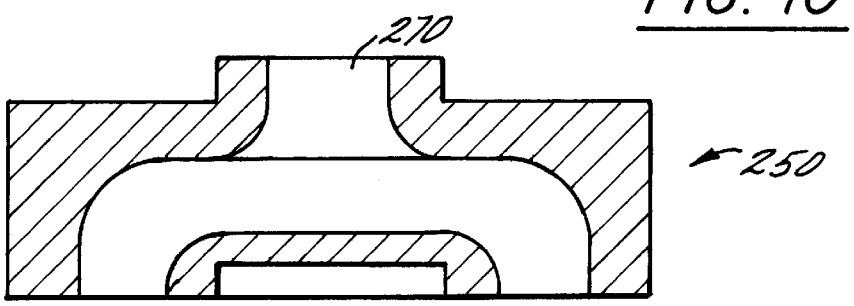
FIG. 11 is a view taken along the line 11—11 of FIG. 10.

Referring to FIGS. 3, 10 and 11, a compressor end plate 250 is mounted on plate 220 by fasteners 252. Fasteners 252 secure plates 96, 220 and 250 to housing 60, as is shown in FIG. 3. Plate 250 has a recess 254 for receiving end cap 234, a recess 256 for receiving end cap 238, and a recess 258 for receiving end cap 242. A belville washer 260 is disposed between the outer race of bearing 224 and plate 250. A belville washer 262 is disposed between the outer race of bearing 226 and plate 250. A belville washer 264 is disposed between the outer race of bearing 230 and plate 250. Plate 250 includes discharge port passage ways 266 and 268 which lead to a compressor outlet 270.

Referring to FIG. 3, motor 18 is supported in housing 60 by a plurality of spaced apart members 272 depending inwardly from housing 60. Motor 18 is preferably a variable speed motor, whereby compressor capacity can be controlled by varying motor speed which directly varies drive rotor 12 speed. A motor retention ring 274 retains motor 18 and is attached to members 272 by fasteners 276. Housing 60 is open at the lower end thereof, i.e., opening 277, and terminates at this lower end in a flanged portion 278 with a plurality of mounting holes 280 therein.

Figure 12:
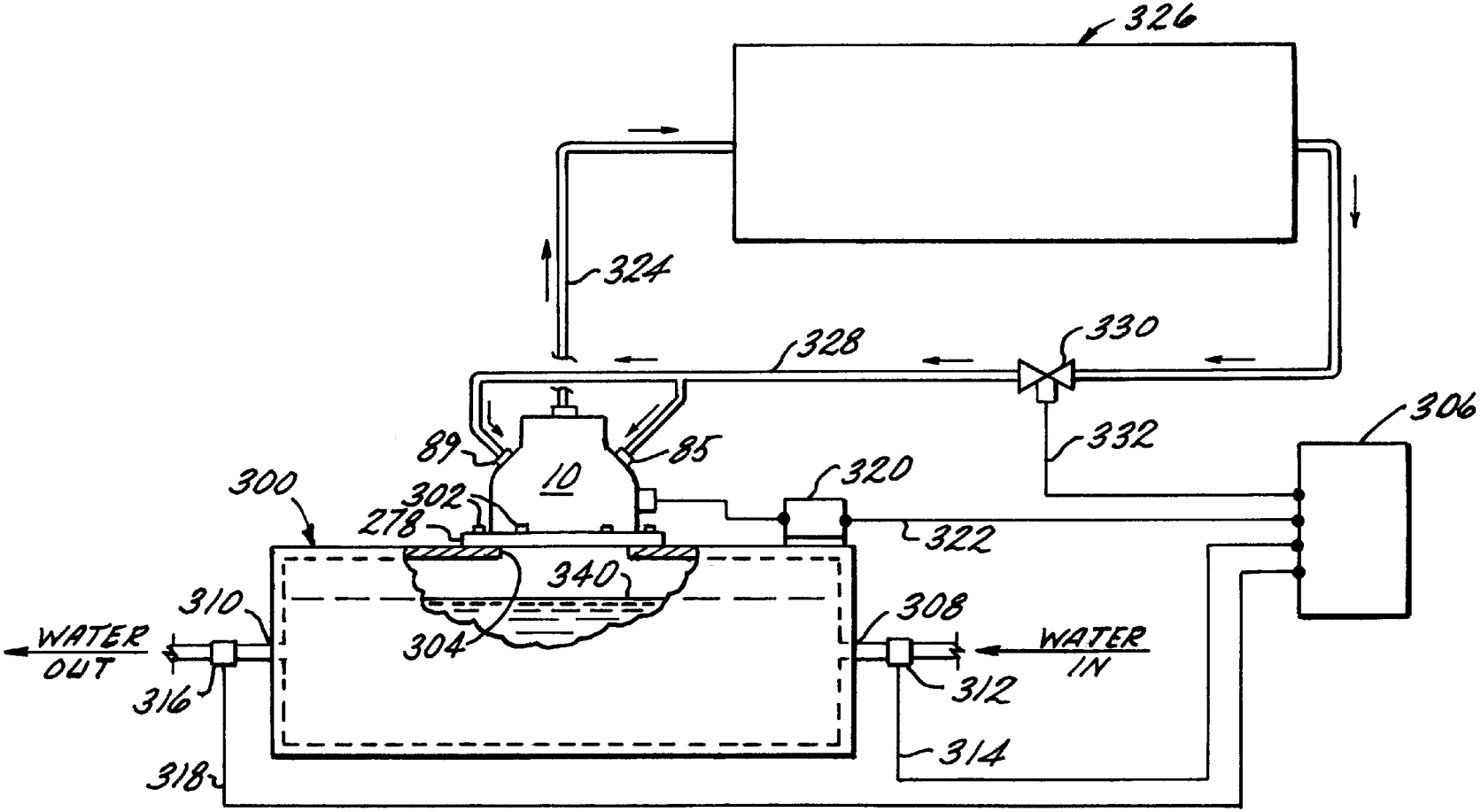
FIG. 12 is a schematic diagram of a variable capacity vapor compression cooling system in accordance with the present invention.

Referring also to FIGS. 3 and 12, compressor 10 is mounted on an evaporator 300 by a plurality of fasteners 302 at holes 280 in flange 278 and corresponding openings in evaporator 300, so that opening 277 of housing 60 of compressor 10 is aligned with an opening 304 at the upper end of evaporator 300. Alternatively, the compressor may be integral with the evaporator, whereby the compressor and evaporator are disposed in the same housing. FIG. 12 is a schematic diagram of a variable capacity vapor compression cooling system in accordance with the present invention. In this example, air conditioning requirements are entered into a microprocessor 306 which controls the system, as described below. Water enters evaporator 300 through an input 308 where it is circulated through tubes within the evaporator and exits through an output 310. As in the prior art, when water temperature rises system capacity is increased and when water temperature drops system capacity is decreased. The entering water temperature is measured by a thermocouple 312 which sends a signal indicative of the entering water temperature to microprocessor 306, via a line 314. The exiting or leaving water temperature is measured by a thermocouple 316 which sends a signal indicative of the exiting water temperature to microprocessor 306, via a line 318. Although not shown the temperature of the water is regulated, with the temperature of the water being controlled by microprocessor 306 in response to the measured temperatures. The regulation of the water temperature allows control of the rate of evaporation of the liquid phase refrigerant in evaporator 300. Liquid phase refrigerant is delivered to evaporator 300 by compressor 10, as described below. More particularly, liquid phase refrigerant is delivered at fittings 85 and 89 which communicate with corresponding channels 87, 88 and channels 91, 92 to passages 90 and 94, respectively. The interlobe/flute cell volume between the respective rotors and respective shell portion 13, 21 and shell portion 17 where this liquid phase refrigerant enters is expanding as the rotors are rotated (driven). This volume expands the two-phase (i.e., a liquid portion and a vapor portion) fluid therein to the desired volume. This expanded fluid within the closed interlobe/flute cells is then exposed to the basic intake plenum of the compressor, whereby the liquid portion of the refrigerant is now thrown out of the interlobe/flute cell by the centrifugal forces of the rotors. The vapor portion remaining in the cell mixes with vapor generated by the evaporator, described below. The liquid portion which has in effect been centrifuged out of the two-phase liquid falls into the evaporator through openings 277 and 304. Further, energy expended in this expansion process is not wasted, as the work of expansion aids in driving the rotors. The closed volume or cell of each of these expansion volumes can be varied by sliding portion 13, 21 and portion 17 of shell 11 (FIG. 5). These shell portions could each be configured as a slide valve which would be microprocessor controlled, thereby allowing the expansion volume to be regulated (varied) to regulate or control the expansion. Accordingly, the compressor also performs the expansion function for the system.

Evaporated refrigerant (i.e., vapor phase refrigerant) and the vapor phase refrigerant from expansion is inducted (drawn) into the compressor at the suction end thereof. The vapor phase refrigerant is compressed by the compressor. The variable speed motor 18 is controlled by a controller 320 which is itself controlled by microprocessor 306, via a line 322. System capacity can be varied by varying the motor speed, and thereby the rotor speed.

The compressed vapor phase refrigerant is then presented by a line 324 to an air (or water) cooled condenser 326, condensing the refrigerant to the liquid phase, as is well known in the art. Thereafter, liquid phase refrigerant is delivered by a line 328 to fittings 85 and 89 of the compressor, as described above, with the flow thereto being regulated by a regulator valve 330. Valve 330 is controlled by microprocessor 306, via a line 332. Control of this flow of liquid phase refrigerant to the compressor provides additional control of system capacity. For example, turning down (i.e., restricting flow) valve 330 will reduce system capacity, such typically being down in conjunction with reducing motor speed.

The liquid phase refrigerant that falls down into the evaporator, as described above, and collects in the evaporator which is flooded with liquid refrigerant to a level indicated by a line 340. As is well known, the liquid refrigerant is boiled resulting in a foam, froth and/or oil rich vapor refrigerant mist, fog or smoke, all of which are referred to herein as foam, forming on top of the liquid level in the evaporator. The prior art seeks to reduce this foaming process with the use of, e.g., anti-foaming agents or other known mechanical means. However, the present invention utilizes this form for compressor cooling, sealing and lubrication. The small amount of oil in the refrigerant, described hereinbefore, tends to be much more highly concentrated towards the top of the liquid refrigerant in the evaporator, as oil is lighter than the liquid refrigerant and the liquid refrigerant is being evaporated. Also, the foam comprises liquid refrigerant having this higher concentration oil and vapor refrigerant. In accordance with an important feature of the present invention, this foam is ingested into the compressor through openings 304 and 277. Motor 18, bearings 62, 72 and 78, and the compression process itself are cooled and lubricated by the oil in the foam. The foam that is drawn into the suction end of the rotors is compressed. More specifically, the vapor contained in the foam is compressed and the liquid in the foam seals and cools the compression process and also serves as a lubricant source for the upper bearings. Much of the oil, having e.g., 25% by weight liquid refrigerant, is carried by the vapor through the compressor. Also, vapor phase refrigerant generated in the evaporator and drawn into the compressor is compressed, as described hereinbefore.

Accordingly, the above describes a complete cycle which can be capacity varied without the internal mechanical unloading of the compressors common in the prior art.

While the above described embodiment has been described with a male rotor having eight lobes, whereby eight discharge pulses per revolution of the male rotor are generated for each of the female rotor for a total of sixteen pulses per revolution, it may be preferred that a male rotor having nine lobes (i.e., an odd number) be employed. The sixteen pulses per revolution actually only generate eight pulses per revolution, since two pulses occur at the same time, i.e., one for each of the female rotors. With a male rotor having nine lobes, eighteen pulses per revolution are generated, i.e., nine pulses per revolution for each of the two female rotors. However, none of these eighteen pulses occur during another one of the pulses, thereby generating a more even or smoother discharge flow, i.e., less noise.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An expansion compression system comprising:

a housing having an input and an output;

a first rotor disposed in said housing;

at least one second rotor disposed in said housing and axially aligned with said first rotor, said first rotor in communication with said at least one second rotor whereby said first rotor drives said at least one second rotor; and a rotor shell disposed about said first rotor and said at least one second rotor, said rotor shell having a first closed portion for providing expansion, a second closed portion for providing compression, and an open portion for providing separation.

2. The expansion compression system of claim 1 further comprising:

a variable speed motor coupled to said first rotor for driving said first rotor.

3. The expansion compression system of claim 1 wherein:

said first closed portion comprising a slide valve.

4. The expansion compression system of claim 1 wherein:

said first closed portion closes off about 15% to 25% of the volume that said second closed portion closes off.

5. The expansion compression system of claim 1 further comprising:

an induction plate disposed at the induction end of said first rotor and said at least one second rotor, said induction plate defining a passage for delivering refrigerant communicated from said input of said housing to an interface of said first rotor and said at least one second rotor.

6. The expansion compression system of claim 5 wherein:

said interface of said first rotor and said at least one second rotor comprises a volume defined by the teeth of said first rotor and the teeth of said at least one second rotor and said first closed portion of said rotor shell.

7. The expansion compression system of claim 5 wherein:

said passage is roughly triangularly shaped with a first side thereof generally following the root circumference of said second rotor, a second side thereof generally following the outside diameter of said first rotor and a third side thereof generally following a corresponding leading edge of a tooth of said second rotor at that position.

8. The expansion compression system of claim 1 further comprising:

a discharge plate disposed at the discharge end of said first rotor and said at least one second rotor, said discharge plate defining discharge porting therein.

9. The expansion compression system of claim 1 wherein:

said first rotor comprises a male rotor having a plurality of lobes with a degree of wrap; and said at least one second rotor comprises at least one female rotor having a plurality of flutes with a degree of wrap.

10. The expansion compression system of claim 9 wherein said male rotor comprises:

a generally cylindrical metal shaft; and a ring having said lobes integrally depending therefrom, said ring disposed on said shaft for rotation therewith, said ring comprised of a composite material.

11. The expansion compression system of claim 9 wherein said at least one female rotor comprises two, three, four or five female rotors.

12. The expansion compression system of claim 9 further comprising:

a discharge disk disposed at a discharge end of said male rotor, said discharge side plate being generally cylindrical and having an outside diameter about the same as a crest diameter of said male rotor.

13. The expansion compression system of claim 9 further comprising:

a discharge disk disposed at a discharge end of said male rotor, said discharge disk being generally cylindrical and having an outside diameter about the same as a crest diameter of said male rotor; and a discharge plate disposed at the discharge end of said first rotor and said at least one second rotor, said discharge plate defining discharge porting therein, said discharge portion including;

an inner circumferential surface for receiving said discharge disk, with a clearance being defined between said inner circumferential surface and an outer circumference of said discharge disk;

a countersunk surface depending from said inner circumferential surface and terminating at an opening, said countersunk surface depending from said inner circumferential surface allows said clearance to be sealed by a liquid in said compressor; and at least one discharge porting scheme positioned for communication with a discharge port area of said at least one female rotor.

14. The expansion compression system of claim 13 wherein said at least one discharge porting scheme comprises:

a first stepped down portion defined by an intersection of said counter sunk surface and said inner circumferential surface, an edge which generally follows a root diameter of said at least one female rotor and a curved edge which communicates with a periphery of remaining discharge port areas of said male rotor and said at least one said female rotor, whereby said first stepped down portion provides trap pocket relief;

a second stepped down portion depending from said first stepped down portion, said second stepped down portion generally aligned with an axial discharge port area of said at least one female rotor; and wherein said first and second stepped down portions lead to a discharge opening generally aligned with a radial discharge area of said male rotor and said axial discharge port area of said at least one female rotor.

15. The expansion compression system of claim 1 further comprising:

a discharge disk disposed at a discharge end of said first rotor; and wherein said first rotor is longer than said second rotor to provide axial clearance between said second rotor and said discharge disk.

16. The expansion compression system of claim 15 further comprising:

an upper first rotor bearing mounted on a first rotor shaft of said first rotor;

an upper second rotor bearing mounted on a second rotor shaft of said second rotor;

a discharge plate disposed at the discharge end of said first rotor and said at least one second rotor, said discharge plate defining discharge porting therein, said discharge plate having a first opening for passthrough of said first rotor shaft, a second opening for passthrough of said second rotor shaft and a recess for receiving said discharge disk;

first bearing spacer disposed on said first rotor shaft at said first opening in said discharge plate, said first bearing spacer having a length equal to about the thickness of said discharge plate; and a second bearing spacer disposed on said second rotor shaft at said second opening in said discharge plate, said second bearing spacer having a length equal to about the sum of the difference between the length of said first and second rotors and the thickness of said discharge plate;

whereby clearances are defined between each of said first and second bearing spacers and respective said first and second openings in said discharge plate and between said discharge disk and said recess in said discharge plate, whereby liquid is leaked through said clearances to said upper first and second rotor bearings for lubrication thereof.

17. The expansion compression system of claim 1 further comprising:

a motor is supported in said housing by a plurality of spaced apart members depending inwardly therefrom.

18. The expansion compression system of claim 1 disposed relative to an evaporator having an evaporator interface opening at the upper portion thereof to provide communication of refrigerant between said expansion compression system through an interface opening at the lower portion of said housing and said evaporator through said evaporator interface opening.

19. The expansion compression system of claim 1 disposed in an upper portion of said housing and further comprising:

an evaporator disposed in a lower portion of said housing.

20. A variable capacity cooling system comprising:

an expansion compression system comprising;

(1) a housing having an interface for communication of refrigerant, an input receptive to liquid phase refrigerant and an output for delivering compressed vapor phase refrigerant;

(2) a first rotor disposed in said housing;

(3) at least one second rotor disposed in said housing and axially aligned with said first rotor, said first rotor in communication with said at least one second rotor whereby said first rotor drives said at least one second rotor;

(4) a rotor shell disposed about said first rotor and said at least one second rotor, said rotor shell having a first closed portion for providing expansion, a second closed portion for providing compression, and an open portion for providing separation; and (5) a variable speed motor coupled to said first rotor for driving said first rotor;

an evaporator receptive to liquid phase refrigerant from said interface of said expansion compression system, said evaporator for evaporating the liquid phase refrigerant therein;

a condenser receptive to the compressed vapor phase refrigerant from said output of said expansion compression system, said condenser for condensing the compressed vapor phase refrigerant to provide the liquid phase refrigerant; and a valve for regulating flow of the liquid phase refrigerant from said condenser to said input of said expansion compression system;

whereby varying the speed of said motor and actuation of said valve varies capacity of said cooling system.

21. The cooling system of claim 20 wherein:

said evaporator includes a tube for circulating water with the temperature of the water being measured whereby capacity of said system is varied, said tube having a water input and a water output.

22. The cooling system of claim 21 further comprising:

a first thermocouple for measuring the temperature of the water at said water input of said tube; and a second thermocouple for measuring the temperature of the water at said water output of said tube;

whereby measured water temperatures are used to regulate the temperature of the water circulating in said tube.

23. The cooling system of claim 20 further comprising:

a processor for generating control signals in response to cooling requirements, said control signals for varying the speed of said motor and actuating said valve.

24. The system of claim 20 wherein said condenser comprises an air or water cooled condenser.

25. The cooling system of claim 20 wherein:

said first closed portion comprising a slide valve.

26. The cooling system of claim 20 wherein:

said first closed portion closes off about 15% to 25% of the volume that said second closed portion closes off.

27. The cooling system of claim 20 further comprising:

an induction plate disposed at the induction end of said first rotor and said at least one second rotor, said induction plate defining a passage for delivering refrigerant communicated from said compressor input to an interface of said first rotor and said at least one second rotor.

28. The cooling system of claim 26 wherein:

said passage is roughly triangularly shaped with a first side thereof generally following the root circumference of said second rotor, a second side thereof generally following the outside diameter of said first rotor and a third side thereof generally following a corresponding tooth of said one second rotor at that position.

29. The cooling system of claim 26 further comprising:

a discharge plate disposed at the discharge end of said first rotor and said at least one second rotor, said discharge plate defining discharge porting therein.

30. The cooling system of claim 24 wherein:

said first rotor comprises a male rotor having a plurality of lobes with a degree of wrap; and said at least one second rotor comprises at least one female rotor having a plurality of flutes with a degree of wrap.

31. The cooling system of claim 29 wherein said at least one female rotor comprises two, three, four or five female rotors.

32. The cooling system of claim 29 further comprising:

a discharge disk disposed at a discharge end of said male rotor, said discharge disk being generally cylindrical and having an outside diameter about the same as a crest diameter of said male rotor.

33. The cooling system of claim 24 wherein said expansion compression system is disposed relative to said evaporator having an evaporator interface opening at the upper portion thereof to provide communication of refrigerant between said expansion compression system through an interface opening at the lower portion of said housing and said evaporator through said evaporator interface opening.

34. The cooling system of claim 24 wherein said expansion compression system is disposed in an upper portion of said housing and said evaporation is disposed in a lower portion of said housing.

35. A method of expansion and compression comprising:

delivering liquid phase refrigerant to an interface of a first rotor having a plurality of teeth and at least one second rotor having a plurality of teeth, said at least one second rotor being axially aligned with said first rotor, said first rotor and said at least one second rotor being disposed in a rotor shell, said rotor shell having a first closed portion for providing expansion, a second closed portion for providing compression, and an open portion for providing separation, said interface of said first rotor and said at least one second rotor comprises a volume defined by the teeth of said first rotor and the teeth of said at least one second rotor and said first closed portion of said rotor shell; and driving said first rotor which in turn drives said at least one second rotor, whereby said volume expands as said first and second rotors are rotated, the liquid phase refrigerant entering said volume is expanded into two-phase refrigerant, said two-phase refrigerant comprising a liquid portion and a vapor portion, said liquid portion is thrown out of said volume at said open portion of said rotor shell by the centrifugal forces and away from said first and second rotors, said vapor portion is compressed at the second closed portion of the rotor shell by the rotation of said first and second rotors.

36. A method of claim 35 further comprising:

collecting in an evaporator said liquid portion of the two-phase refrigerant that is thrown out of said volume to provide a level of liquid phase refrigerant in said evaporator;

boiling said liquid phase refrigerant in said evaporator to generate vapor phase refrigerant, whereby a foam is formed on top of the level of liquid phase refrigerant in said evaporator;

ingesting said foam into said first and second rotors, said foam comprising vapor phase refrigerant with some oil or liquid phase refrigerant therein, the vapor phase refrigerant contained in the foam is compressed at said second closed portion of the rotor shell by the rotation of said first and second rotors and the oil or liquid phase refrigerant contained in the foam is entrained in the flow of the vapor portion to provide lubrication, said vapor portion from said volume mixes with the vapor phase refrigerant from said foam at said first and second rotors; and condensing compressed vapor phase refrigerant from said first and second rotors in a condenser to provide the liquid phase refrigerant which is delivered to said interface of said first and second rotors.

37. The method of claim 35 further comprising:

varying the speed at which said first rotor is driven to vary capacity of said system.

38. The method of claim 35 further comprising:

varying said volume to vary capacity of said system.

39. The method of claim 35 further comprising:

regulating flow of liquid phase refrigerant from said condenser to said interface of said first and second rotors to vary capacity of said system.

40. The method of claim 35 further comprising the step of:

circulating water through a tube in said evaporator, said tube having a water input and a water output; and regulating the temperature of the water being circulated to vary capacity of said system.

41. The method of claim 35 further comprising the steps of:

measuring the temperature of the water at said water input of said tube;

measuring the temperature of the water at said water output of said tube; and wherein said step of regulating the temperature of the water circulating in said tube comprises regulating the water temperature in response to said measured temperatures.

42. A system comprising:

a compressor having;

(1) a first rotor; and (2) at least one second rotor axially aligned with said first rotor, said first rotor in communication with said at least one second rotor whereby said first rotor drives said at least one second rotor;

an evaporator receptive to liquid phase refrigerant for boiling said liquid phase refrigerant therein to generate vapor phase refrigerant such that a foam is formed on top of the level of liquid phase refrigerant in said evaporator, said evaporation being disposed relative to said compressor for ingesting said foam into said first and second rotors, said foam comprising vapor phase refrigerant with some oil or liquid phase refrigerant therein, whereby the vapor phase refrigerant contained in the foam is compressed by the rotation of said first and second rotors and the oil or liquid phase refrigerant contained in the foam is entrained in the flow of the vapor portion to provide lubrication for said compressor;

a variable speed motor coupled to said first rotor for driving said first rotor;

an induction plate disposed at the induction end of said first rotor and said at least one second rotor, said induction plate defining a passage for delivering refrigerant to an interface of said first rotor and said at least one second rotor; and said passage being roughly triangularly shaped with a first side thereof generally following the root circumference of said second rotor, a second side thereof generally following the outside diameter of said first rotor and a third side thereof generally following a corresponding leading edge of a tooth of said second rotor at that position.

43. A system comprising:

a compressor having;

(1) a first rotor; and (2) at least one second rotor axially aligned with said first rotor, said first rotor in communication with said at least one second rotor whereby said first rotor drives said at least one second rotor, an evaporator receptive to liquid phase refrigerant for boiling said liquid phase refrigerant therein to generate vapor phase refrigerant such that a foam is formed on top of the level of liquid phase refrigerant in said evaporator, said evaporation being disposed relative to said compressor for ingesting said foam into said first and second rotors, said foam comprising vapor phase refrigerant with some oil or liquid phase refrigerant therein, whereby the vapor phase refrigerant contained in the foam is compressed by the rotation of said first and second rotors and the oil or liquid phase refrigerant contained in the foam is entrained in the flow of the vapor portion to provide lubrication for said compressor;

a discharge plate disposed at the discharge end of said first rotor and said at least one second rotor, said discharge plate defining discharge porting therein;

said first rotor comprises a male rotor having a plurality of lobes with a degree of wrap;

said at least one second rotor comprises at least one female rotor having a plurality of flutes with a degree of wrap;

said male rotor comprises:

a generally cylindrical metal shaft; and a ring having said lobes integrally depending therefrom, said ring disposed on said shaft for rotation therewith, said ring comprised of a composite material.

44. A system comprising:

a compressor having;

(1) a first rotor; and (2) at least one second rotor axially aligned with said first rotor, said first rotor in communication with said at least one second rotor whereby said first rotor drives said at least one second rotor;

an evaporator receptive to liquid phase refrigerant for boiling said liquid phase refrigerant therein to generate vapor phase refrigerant such that a foam is formed on top of the level of liquid phase refrigerant in said evaporator said evaporation, being disposed relative to said compressor for ingesting said foam into said first and second rotors, said foam comprising vapor phase refrigerant with some oil or liquid phase refrigerant therein, whereby the vapor phase refrigerant contained in the foam is compressed by the rotation of said first and second rotors and the oil or liquid phase refrigerant contained in the foam is entrained in the flow of the vapor portion to provide lubrication for said compressor;

a discharge plate disposed at the discharge end of said first rotor and said at least one second rotor, said discharge plate defining discharge porting therein;

said first rotor comprises a male rotor having a plurality of lobes with a degree of wrap;

said at least one second rotor comprises at least one female rotor having a plurality of flutes with a degree of wrap; and a discharge disk disposed at a discharge end of said male rotor, said discharge disk being generally cylindrical and having an outside diameter about the same as a crest diameter of said male rotor.

* * * * *